US005980153A

United States Patent [19]

Plemons et al.

[11] Patent Number: 5,980,153

[45] Date of Patent: Nov. 9, 1999

[54] TELESCOPING AUGER SHAFT AND METHOD OF MANUFACTURE

[75] Inventors: Carl Dean Plemons, Waco; Calvin Lynn Stegemoeller, Hewitt, both of Tex.

[73] Assignee: Akzo Nobel Asphalt Applications, Inc., Waco, Tex.

[21] Appl. No.: 09/126,465

[22] Filed: Jul. 30, 1998

[51] Int. Cl.[6] ..... E01C 19/12; E01C 19/18; E01C 19/22; B65G 33/00

[52] U.S. Cl. ..... 404/72; 404/92; 404/101; 404/110; 404/115; 198/657

[58] Field of Search ..... 404/72, 92, 110, 404/112, 113, 115, 101; 198/657

[56] References Cited

U.S. PATENT DOCUMENTS

| | | | |
|---|---|---|---|
| 2,328,888 | 9/1943 | Bell | 404/92 |
| 3,260,176 | 7/1966 | Bowers | 94/39 |
| 3,353,798 | 11/1967 | Draper et al. | 259/149 |
| 3,453,939 | 7/1969 | Pollitz et al. | 94/46 |
| 3,478,830 | 11/1969 | Levesque et al. | 177/16 |
| 3,820,914 | 6/1974 | Zimmerman | 404/110 |
| 3,967,912 | 7/1976 | Parker | 404/84 |
| 4,012,160 | 3/1977 | Parker | 404/84 |
| 4,089,509 | 5/1978 | Morton et al. | 366/8 |
| 4,222,498 | 9/1980 | Brock | 222/58 |
| 4,298,288 | 11/1981 | Weisbrod | 366/8 |
| 4,298,555 | 11/1981 | Weltmer | 264/31 |
| 4,475,818 | 10/1984 | Bialkowski | 366/17 |
| 4,506,982 | 3/1985 | Smithers et al. | 366/19 |
| 4,534,674 | 8/1985 | Cutler | 404/75 |
| 4,708,520 | 11/1987 | Rowe | 404/103 |
| 4,749,304 | 6/1988 | Craig | 404/101 |
| 4,772,156 | 9/1988 | Craig | 404/101 |
| 4,781,466 | 11/1988 | Zimmerman | 366/2 |
| 4,823,366 | 4/1989 | Williams | 377/2 |
| 5,002,426 | 3/1991 | Brown et al. | 404/92 |
| 5,044,819 | 9/1991 | Kilheffer et al. | 404/72 |
| 5,099,986 | 3/1992 | Kuzub | 198/666 |
| 5,120,155 | 6/1992 | Samspon | 404/110 |
| 5,240,324 | 8/1993 | Phillips et al. | 366/132 |
| 5,294,210 | 3/1994 | Lemelson et al. | 404/84.1 |
| 5,330,265 | 7/1994 | Keating, Jr. et al. | 366/7 |
| 5,376,950 | 12/1994 | Söderholm et al. | 346/16 |
| 5,590,976 | 1/1997 | Kilheffer et al. | 404/72 |

*Primary Examiner*—Thomas B. Will
*Assistant Examiner*—Gary S. Hartmann
*Attorney, Agent, or Firm*—Baker & Botts, L.L.P.

[57] ABSTRACT

A telescoping auger shaft is provided that distributes slurry material throughout a spreader box of variable width in a paving system. The telescoping auger shaft comprises a first shaft positioned coaxially with and engaging a second shaft such that the second shaft is operable to extend with respect to the first shaft while remaining engaged with the first shaft. The two shafts can form a combined shaft of variable length. The telescoping auger shaft further comprises two sections of auger flighting, one coupled to the first shaft and one coupled to the second shaft. The two sections of auger flighting are operable to distribute slurry material in a spreader box when the first shaft and the second shaft are rotated. The first shaft includes a guide portion. A guide element is coupled to second shaft and engages with the guide portion. When the second shaft is extended with respect to the first shaft, the guide element can cause the second shaft to rotate with respect to the first shaft.

27 Claims, 5 Drawing Sheets

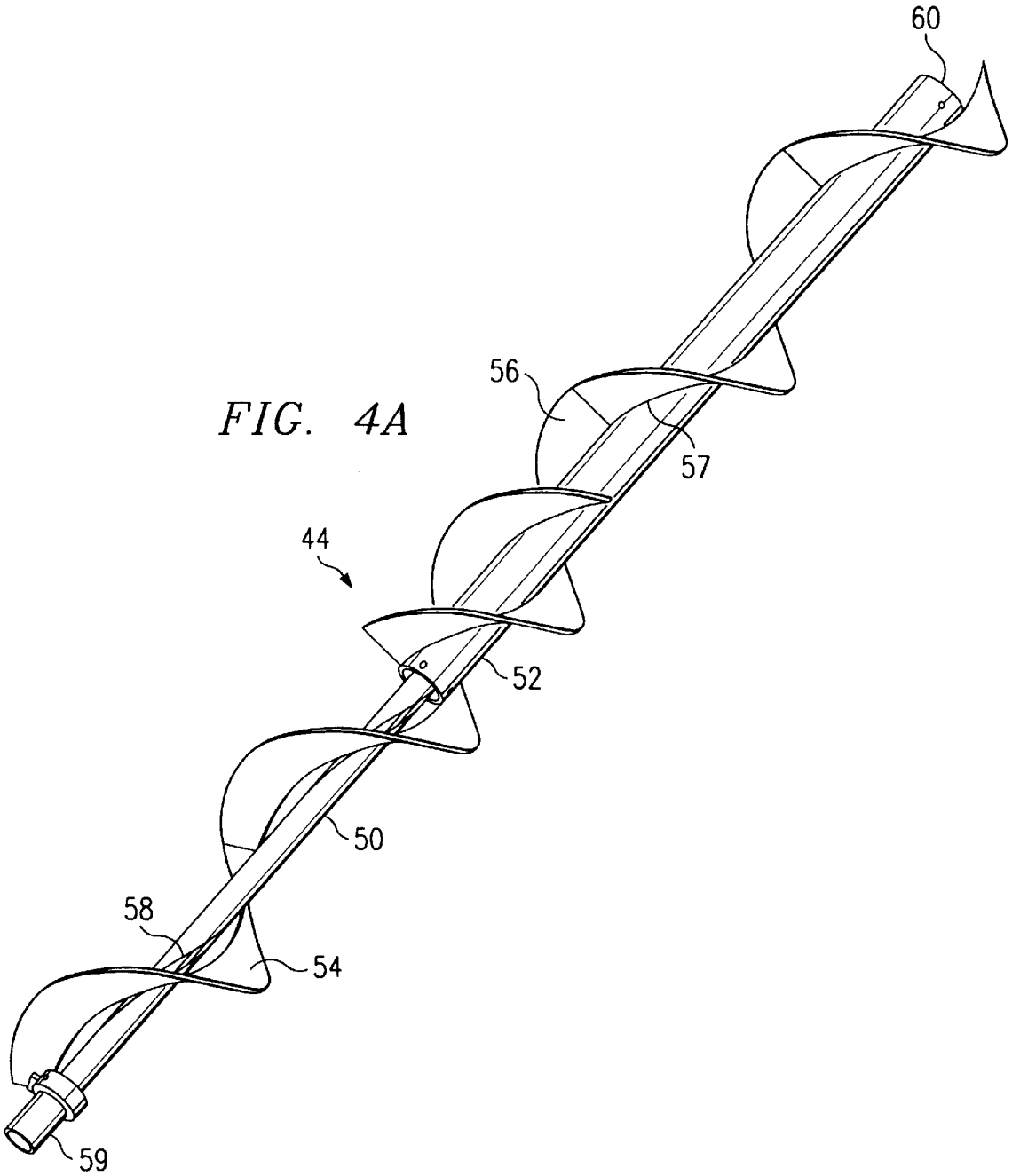
FIG. 4A
FIG. 4B
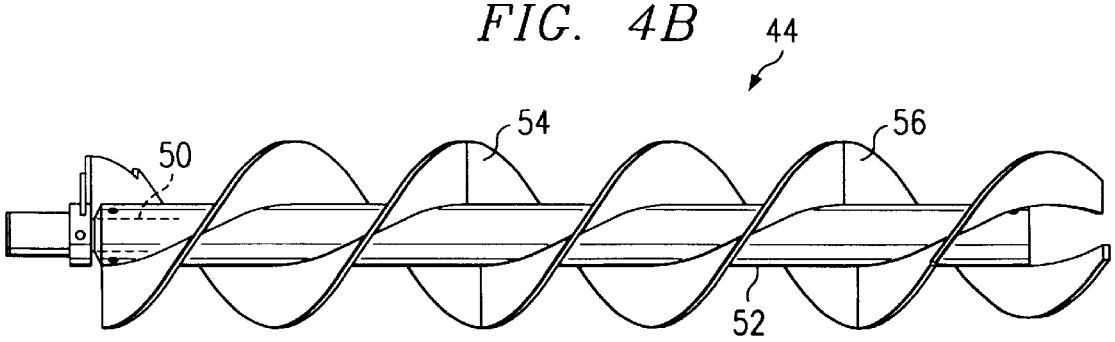

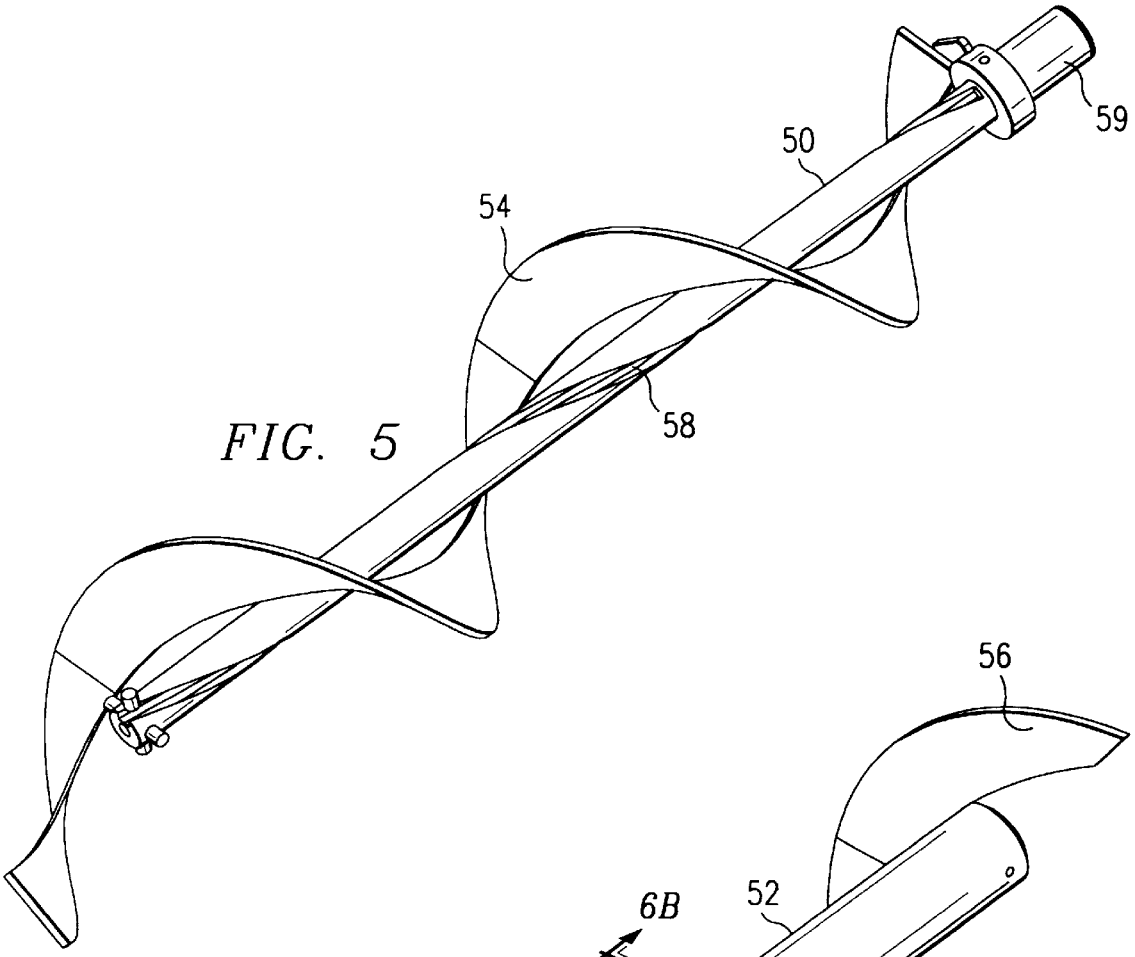
FIG. 5
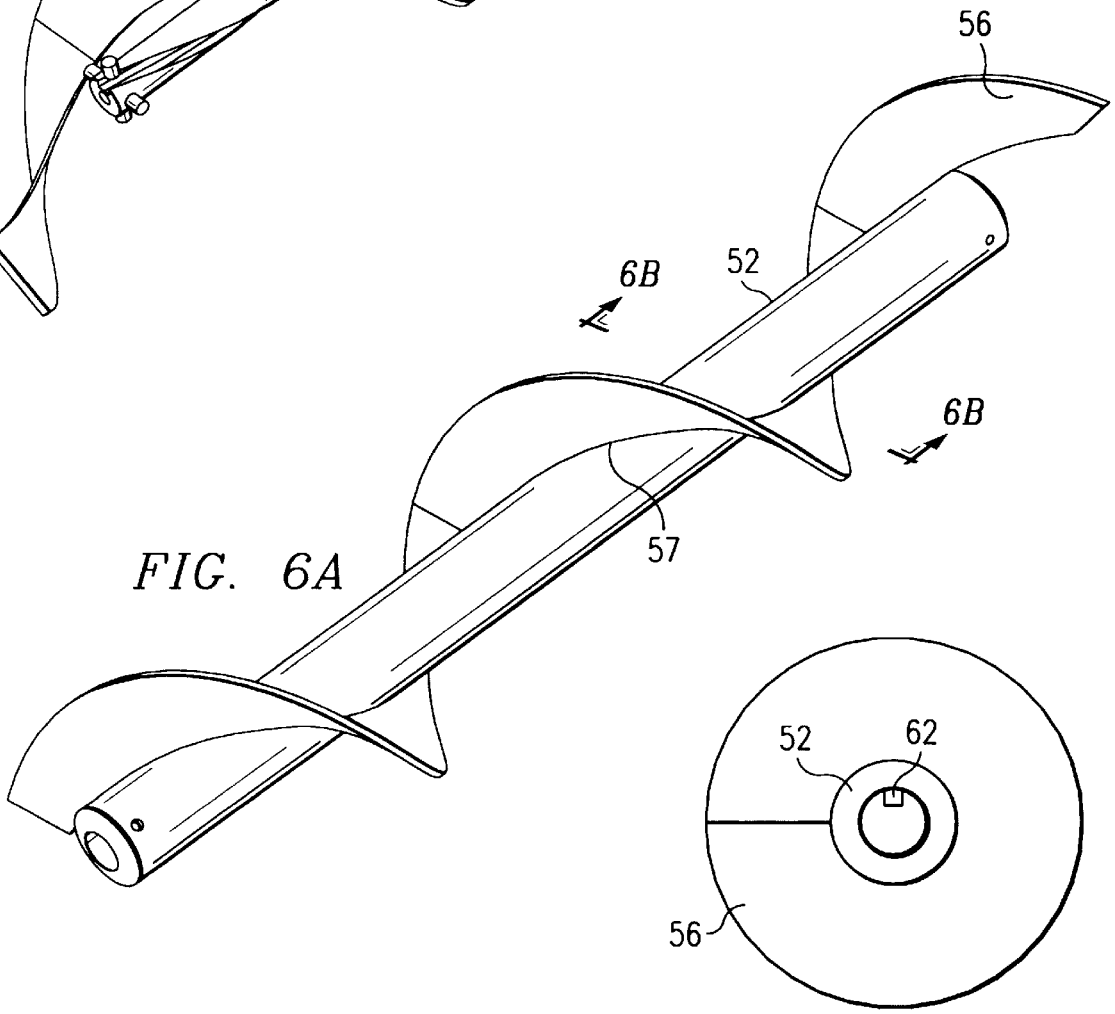
FIG. 6A
FIG. 6B

TELESCOPING AUGER SHAFT AND METHOD OF MANUFACTURE

TECHNICAL FIELD OF THE INVENTION

The present invention relates generally to the field of road construction equipment and more particularly to a telescoping auger shaft and method of manufacture.

BACKGROUND OF THE INVENTION

Asphalt emulsion based surface treatments such as asphalt slurry and microsurfacing are used to maintain asphalt pavements. The application of such surface treatments extends the life of existing pavements and repairs pavement surface problems such as raveling (loss of aggregate), weathering, wheel path rutting, and loss of roughness or slick wheel paths. The slurry can be mixed by a mobile slurry machine and applied to the pavement surface in a continuous or batch process. One such mobile paving system is disclosed in U.S. Pat. No. 5,590,976, entitled "Mobile Paving System Using an Aggregate Moisture Sensor and Method of Operation."

A mobile paving system can deposit slurry onto a surface through a box type screed pulled behind the slurry machine. The box type screed can be called a "spreader box." The ability of the mobile paving system to satisfactorily apply the slurry to the surface can depend upon the ability of the system to evenly distribute the slurry across the full width of the spreader box. Mobile paving systems can use auger flighting or paddles mounted on rotating shafts to distribute the slurry across the full width of the spreader box.

The spreader box width determines the width of the surface that can be treated. Current systems can allow operators to change the spreader box width by physically adding or removing sections of the spreader box, accompanying auger flights or paddles, and strike-off devices. A disadvantage associated with such systems is that the process to change sections is labor intensive and may take hours to accomplish when the box is covered with hardened slurry material. Because of the difficulty in changing the sections of the spreader box, operators of the mobile paving systems often do not adjust the spreader box. Most roadway surfaces require multiple passes of the spreader box to cover the entire roadway surface. This, in turn, may create overlap of the applied surfacing material as multiple passes of the mobile slurry machine pass over the same areas. Such overlap wastes slurry material and creates an uneven surface.

SUMMARY OF THE INVENTION

In accordance with the present invention, a telescoping auger shaft and method of manufacture are disclosed that provide advantages over previously developed paving systems.

According to one embodiment of the present invention, a telescoping auger shaft for distributing slurry material throughout a spreader box of variable width is provided. The telescoping auger shaft comprises a first shaft having a guide portion. A second shaft positions coaxially with and engages the first shaft such that the second shaft is operable to extend with respect to the first shaft while remaining engaged with the first shaft. The two shafts form a combined shaft of variable length. The telescoping auger shaft further comprises a first section of auger flighting coupled to the first shaft and a second section of auger flighting coupled to the second shaft. The two sections of auger flighting are operable to distribute the slurry material in the spreader box when the first shaft and second shaft are rotated. The telescoping auger shaft further comprises a guide element coupled to the second shaft and engaging the guide portion of the first shaft. When the second shaft is extended with respect to the first shaft, the guide element can cause the second shaft to rotate with respect to the first shaft.

According to another embodiment of the present invention the second shaft comprises an interior portion formed to receive the first shaft. Such an embodiment creates a variable portion of the second shaft that is coextensive with the first shaft.

A further embodiment is disclosed wherein the guide portion comprises a groove formed into an exterior surface of the first shaft. In this embodiment, the guide element comprises a guide pin coupled to an interior surface of the second shaft and engaging the groove.

A technical advantage of the present invention is the ability of the telescoping auger shaft to distribute slurry material throughout a spreader box of variable width. As an expandable spreader box changes width size, the two shafts move longitudinally with respect to each other and thus cover the entire width of the spreader box. It is also a technical advantage of the invention that an operator of a mobile slurry machine and/or spreader box can change the width of the spreader box without the need to add sections to or remove sections from the spreader box shafts.

A further technical advantage of the present invention is that slurry material is evenly distributed throughout the spreader box. The auger flighting comprises flighting in approximately the same density throughout the length of the telescoping auger shaft. Thus, slurries of high or low viscosity can be evenly distributed by the telescoping auger shaft.

Additional technical advantages of the present invention should be apparent to one of ordinary skill in the art from the description, drawings, and claims.

BRIEF DESCRIPTION OF THE DRAWINGS

A more complete understanding of the present invention and advantages thereof may be acquired by referring to the following description taken in conjunction with the accompanying drawings in which like reference numbers indicate like features and wherein:

FIGS. 4A and 4B are diagrams of one embodiment of a telescoping auger shaft according to the present invention;

FIG. 5 is a diagram of one embodiment of a male portion of a telescoping auger shaft according to the present invention; and FIGS. 6A and 6B are diagrams of one embodiment of a female portion of a telescoping auger shaft according to the present invention.

DETAILED DESCRIPTION OF THE INVENTION

Figure 1:
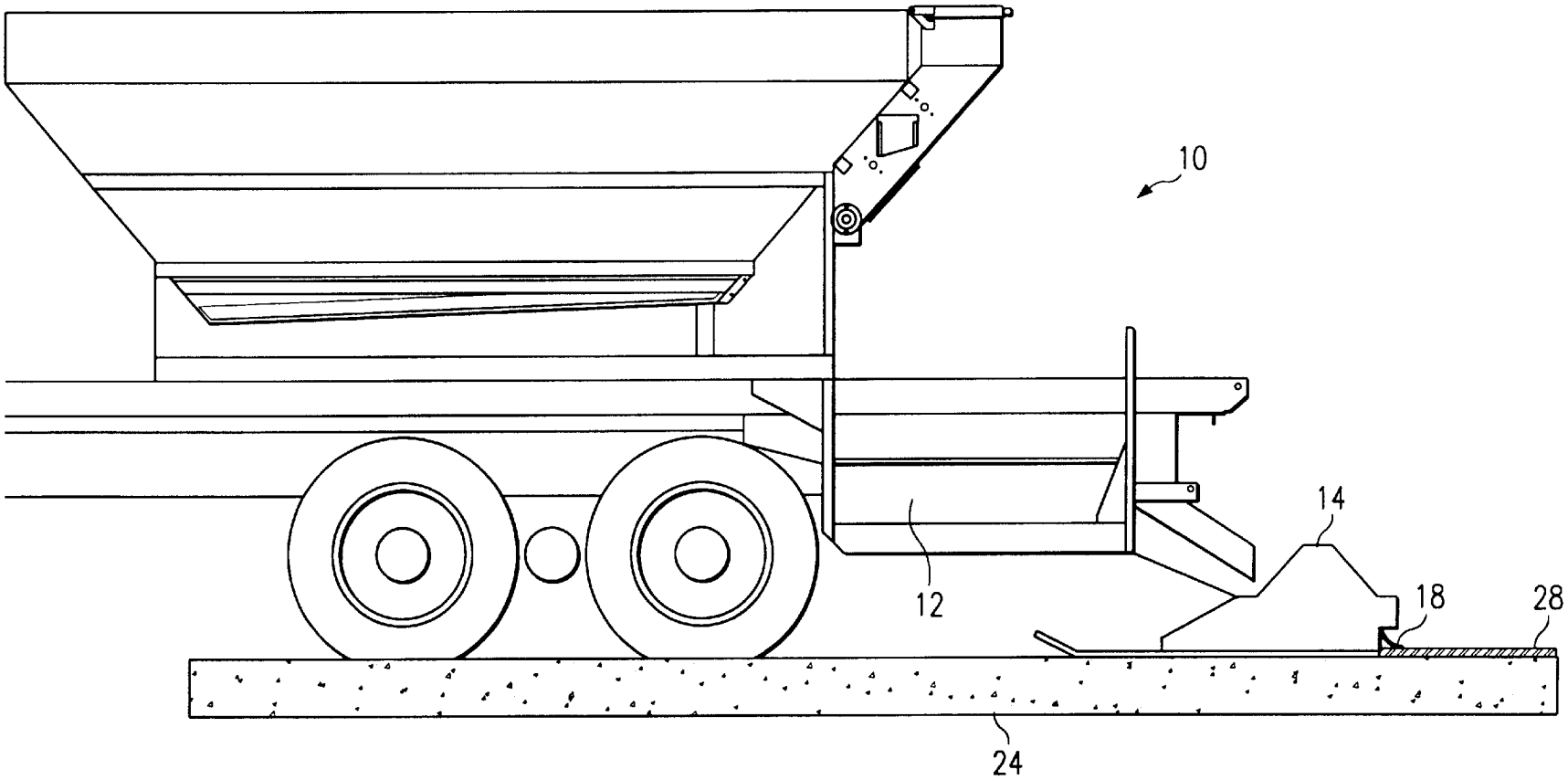
FIG. 1 is a diagram of a mobile slurry system with an expandable spreader box.

FIG. 1 is a diagram of a mobile slurry system with an expandable spreader box. Mobile slurry system, indicated generally at 10, comprises mixer 12 in connection with a spreader box 14 which, in turn, is in connection with a screed 18. In operation, mobile slurry machine 10 travels along existing pavement 24. Mobile slurry machine 10 collates aggregate or slurry in mixer 12 and deposits the slurry into spreader box 14. Spreader box 14 deposits the slurry material 28 onto existing pavement 24 through screed 18, which operates to allow even application of slurry material 28. Screed 18 can be adjusted to change the amount of slurry material 28 which is deposited onto pavement 24. Typically, a spreader box shaft extends across the inside of spreader box 14 and distributes the slurry in spreader box 14.

Spreader box 14 can be an expandable spreader box, having a variable width. In general, an expandable spreader box is a spreader box comprising sides that can be moved, for example by hydraulic rams, such that spreader box 14 can apply slurry 28 to surfaces 24 of varying widths.

Figure 2A:
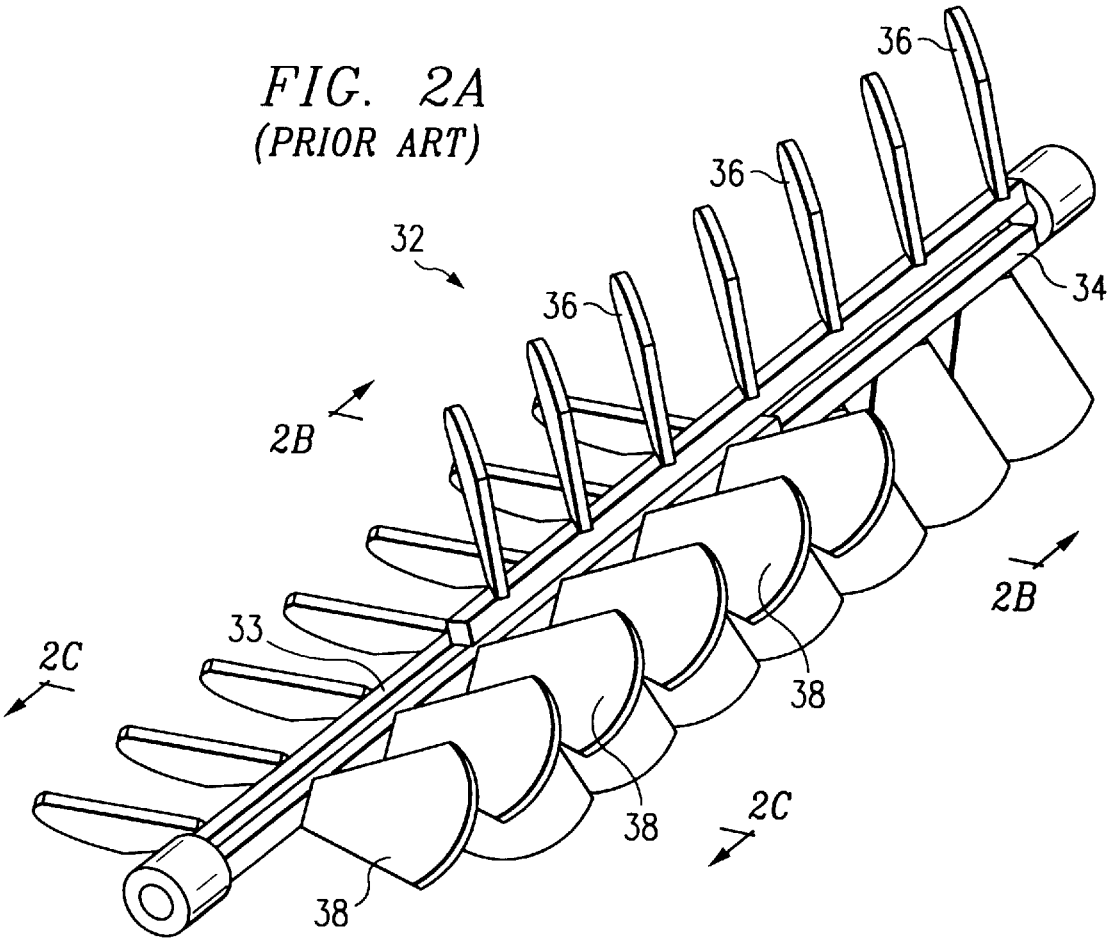
FIG. 2A (PRIOR ART)
FIGS. 2A, 2B, and 2C illustrate a conventional spreader box shaft using paddles.
Figure 2B:
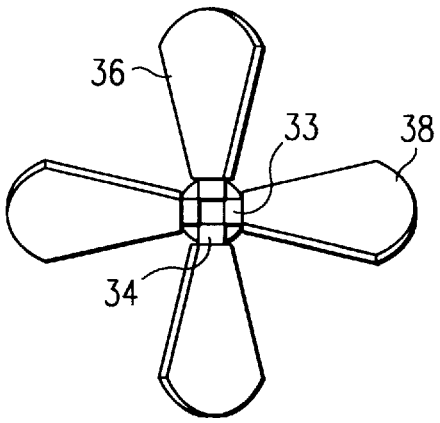
FIG. 2B (PRIOR ART)
Figure 2C:
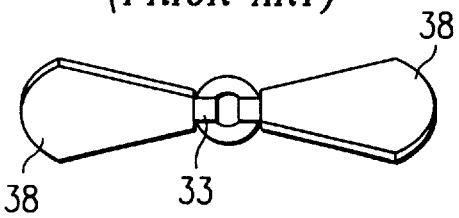
FIG. 2C (PRIOR ART)

FIGS. 2A, 2B, and 2C illustrate a conventional spreader box shaft using paddles. Spreader box shaft, indicated generally at 32, fits inside and extends across one-half of the total width of the spreader box. Spreader box shaft 32 can comprise a first shaft 33 and a second shaft 34 that engage one another. Shaft 33 can include paddles 38, and shaft 34 can include paddles 36. In the illustrated embodiment, paddles 36 and 38 are positioned on shafts 33 and 34 such that they are 90degrees apart with respect to each other when shafts 32 and 34 are engaged.

In operation, shaft 33 and shaft 34 movably engage such that shaft 33 and shaft 34 can move axially with respect to each other. This allows the entire spreader box shaft 32 to be expandable and to adjust to a spreader box of varying width. Thus, when spreader box shaft 32 is placed into an expandable spreader box, spreader box shaft can expand as the spreader box is expanded. Further in operation, spreader box shaft 32 rotates to distribute the slurry inside the spreader box.

One disadvantage with such conventional systems is that the slurry is unevenly distributed due to a change in the density of paddles 36 and 38 along the length of spreader box shaft 32. For example, FIG. 2B is a cross section of spreader box shaft 32 where indicated on FIG. 2A. FIG. 2B shows that, at this middle section where first shaft 33 and second shaft 34 overlap, both paddles 36 and paddles 38 are present and rotate to distribute the slurry material. However, as shown by FIG. 2C, a cross section as indicated on FIG. 2A near the end of spreader box shaft 32, only paddles 38 (or 36) are present. Thus, at this portion spreader box shaft 32 contains fewer paddles 38. As a result of the varying density of paddles along spreader box shaft 32, there is a varying efficiency in the distribution of slurry material.

Such a conventional design may be adequate for low viscosity slurries, but is deficient when the slurry material has a higher viscosity such as microsurfacing material. A further problem is that the paddles 36 and 38 do not adequately convey the slurry material to the furthest ends of the spreader box when the slurry level in the spreader box is below a center line of spreader box shaft 32. In addition, some conventional designs may increase the speed of the rotation of spreader box shaft 32 in order to achieve a better distribution of the slurry across the spreader box. However, a further disadvantage occurs with such designs as the increased rotation can cause an excessive amount of the material to splash out of the spreader box.

Figure 3:
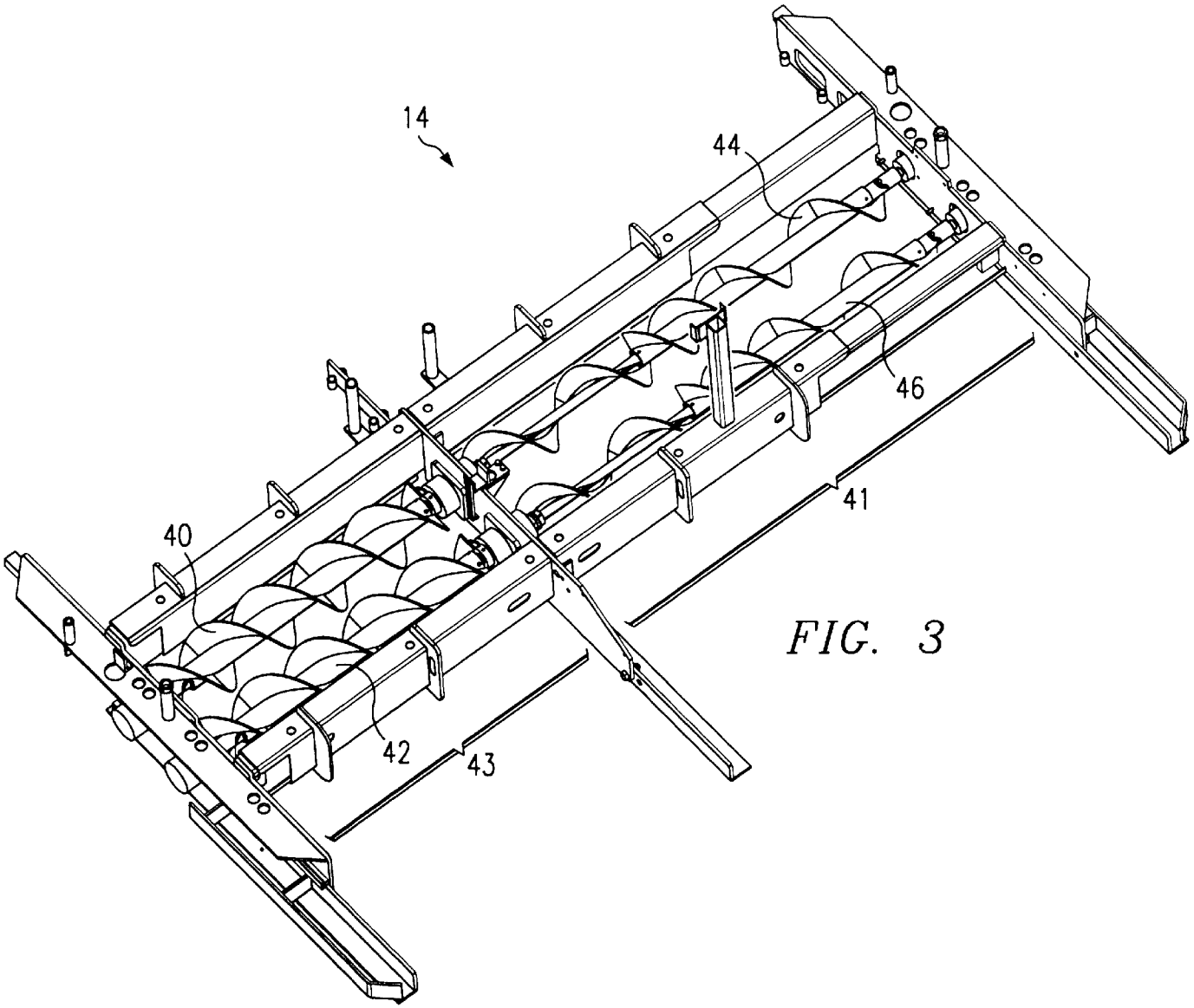
FIG. 3 is a diagram of one embodiment of an expandable spreader box using telescoping auger shafts according to the present invention.

FIG. 3 is a diagram of one embodiment of an expandable spreader box using telescoping auger shafts according to the present invention. As shown, spreader box 14 can comprise two sections 41 and 43. In this embodiment, each section 41 and 43 contains two telescoping auger shafts. In particular, spreader box section 41 comprises telescoping auger shafts 44 and 46, and spreader box section 43 comprises telescoping auger shafts 40 and 42.

In operation, spreader box 14 can be pulled behind a mobile slurry machine in the direction indicated in FIG. 3. Slurry material is distributed in spreader box 14 when telescoping auger shafts 40, 42, 44, and 46, rotate. As shown in FIG. 3 either section 41 or 43 can be expanded. However, in FIG. 3, only section 41 is shown as expanded.

In operation, as section 41 expands, auger shafts 44 and 46 also expand such that the slurry material will be evenly distributed throughout the width of section 41.

The embodiment of FIG. 3 shows spreader box 14 with two sections 41 and 43, wherein each section includes two telescoping auger shafts. However, it is possible and fully contemplated by the present invention that spreader box 14 could contain any number of sections, each section with one or more telescoping auger shafts.

FIGS. 4A and 4B are diagrams of one embodiment of a telescoping auger shaft 44 according to the present invention. In FIG. 4A, the telescoping auger shaft 44 is shown as extended. In FIG. 4B, the telescoping auger shaft is shown as retracted. In the embodiment of FIG. 4A, telescoping auger shaft 44 comprises male shaft 50 that coaxially couples to female shaft 52. Male shaft 50 includes auger flighting 54 and guide portion 58. In the embodiment shown, guide portion 58 is a groove 58 formed into the outer surface of male shaft 50. Female shaft 52 is comprised of auger flighting 56 as well as a guide element. The guide element can be a guide pin coupled to an interior surface of female shaft 52 that engages groove 58. The guide element and guide portion 58 engage together to cause female shaft 52 to rotate with respect to male shaft 50 when female shaft 52 extends with respect to male shaft 50. Those skilled in the art will recognize that there are alternate methods to form the guide element and guide portion. Further in the embodiment shown, auger flighting 56 is fixedly attached to female shaft 52 along an inside edge 57 of auger flighting 56. Additionally in this embodiment, auger flighting 54 is fixedly attached to male shaft 50 at an end 59 distal from female shaft 52.

In operation, female shaft 52 can move axially with respect to male shaft 50. Male shaft 50 engages an inner portion of female shaft 52 such that a portion of female shaft 52 is coextensive with male shaft 50. In this fashion, telescoping auger shaft 44 can vary in length. As female shaft 52 moves with respect to male shaft 50, the guide pin engages and moves in groove 58, and operates to rotate female shaft 52 with respect to male shaft 50. In this fashion, groove 58 and guide pin can prevent auger flighting 56 attached to female shaft 52 from interfering with auger flighting 54 that is attached to the end of male shaft 58. Furthermore, in this embodiment, auger flighting 54 is fixedly attached only to the end of male shaft 50 such that auger flighting 54 can slide on the top of female shaft 52 as female shaft 52 moves along male shaft 50. In one embodiment, a portion of auger flighting 54 on male shaft 50 remains in connection with female shaft 52. Further, end 59 of male shaft 54 can be attached to one side of the spreader box and end 60 of female shaft 52 can be attached to the other side of the spreader box.

FIG. 4B is a diagram of one embodiment of a telescoping auger shaft in the retracted state according to the present invention. Female shaft 52 is formed to receive male shaft 50. As shown in FIG. 4B, female shaft 52 has rotated with respect to male shaft 50 such that auger flighting 56 coupled to female shaft 52 does not interfere with auger flighting 54 coupled to male shaft 50.

It is a technical advantage of the present invention that telescoping auger shaft 44 can vary in length to accommodate the changing width of an expandable spreader box. It is a further technical advantage of the present invention that auger flighting 54 and 56 provide for a continuous distribution of slurry material throughout the width of the spreader box by providing a continuous density of auger flighting. It is a further technical advantage of the present invention that telescoping auger shaft 44 is effective in distributing high or low viscosity slurry material.

FIG. 5 is a diagram of one embodiment of a male portion 50 of a telescoping auger shaft according to the present invention. As mentioned, male shaft 50 can comprise auger flighting 54 and groove 58, which serves as a guide portion. In the embodiment of FIG. 5, as is the case with the embodiment shown in FIG. 4, auger flighting 54 is fixedly attached only to one end 59 of male shaft 50. Auger flighting 54 can also have a predetermined spiral pattern and pitch. Groove 58 can then have the same pitch and direction as auger flighting 54. Groove 58 can, for example, be a groove etched or carved into the outer surface of male shaft 50. Additionally, auger flighting 54 can be coupled to male shaft 50 such that there is a space between auger flighting 54 and male shaft 50. This space can allow the female shaft to slide between male shaft 50 and auger flighting 54. When coupled together, male shaft 50 and female shaft then form a combined telescoping auger shaft of variable length.

FIGS. 6A and 6B are diagrams of one embodiment of a female portion 52 of a telescoping auger shaft according to the present invention. Female shaft 52 comprises auger flighting 56 which can be fixedly attached to female shaft 52. In the embodiment shown, auger flighting 56 is fixedly attached to female shaft 52 along inside edge 57 of auger flighting 56. Female shaft 52 further comprises a guide element 62, shown in FIG. 6B.

FIG. 6B is a cross-sectional view of the embodiment of FIG. 6A. As shown in the cross-sectional view of FIG. 6B, guide element 62 can be a guide pin 62 coupled to an interior surface of female shaft 52. In operation, guide pin 62 engages groove 58 as shown in FIG. 5 as female shaft 52 moves axially with respect to male shaft 50. Thus, female shaft 52 rotates with respect with male shaft 50 such that auger flighting 56 does not interfere with auger flighting 54 as the combined shaft expands or retracts.

Although the present invention has been described in detail, it should be understood that various changes, substitutions and alterations can be made thereto without departing from the spirit and scope of the invention as defined by the appended claims.

What is claimed is:

1. An apparatus for distributing slurry material throughout a spreader box of variable width used in a paving system, the apparatus comprising:

a first shaft having a guide portion;

a second shaft positioned coaxially with and engaging the first shaft such that the second shaft is operable to extend with respect to the first shaft while remaining engaged with the first shaft, the first and second shafts forming a combined shaft of variable length;

a first section of auger flighting coupled to the first shaft;

a second section of auger flighting coupled to the second shaft, wherein the first and second sections of auger flighting are operable to distribute a slurry material in a spreader box when the first shaft and second shaft are rotated; and a guide element coupled to the second shaft and engaging the guide portion of the first shaft, the guide element causing the second shaft to rotate with respect to the first shaft when the second shaft is extended with respect to the first shaft.

2. The apparatus of claim 1, wherein the second shaft comprises an interior portion formed to receive the first shaft such that a variable portion of the second shaft is coextensive with the first shaft.

3. The apparatus of claim 2, wherein the second section of auger flighting is fixedly coupled to the second shaft along an inside edge of the second section of auger flighting.

4. The apparatus of claim 3, wherein the first section of auger flighting is coupled to an end of the first shaft distal from the second shaft.

5. The apparatus of claim 4, wherein the first section of auger flighting is in contact with the portion of the second shaft that is coextensive with the first shaft.

6. The apparatus of claim 2, wherein the guide portion of the first shaft comprises a groove formed into an exterior surface of the first shaft.

7. The apparatus of claim 6 wherein the guide element comprises a guide pin coupled to an interior surface of the second shaft that engages the groove.

8. The apparatus of claim 1, wherein the first shaft is coupled to a first side of the spreader box at an end distal from the second shaft, and the second shaft is coupled to a second side of the spreader box at an end distal from the first shaft.

9. The apparatus of claim 1, wherein the first and second sections of auger flighting have a predetermined pitch and spiral direction.

10. An apparatus for distributing slurry material throughout a spreader box of variable width used in a paving system, the apparatus comprising:

a first shaft having a groove formed into an exterior surface;

a second shaft comprising an interior portion formed to receive the first shaft, the second shaft positioned coaxially with and engaging the first shaft such that the second shaft is operable to extend with respect to the first shaft while remaining engaged with the first shaft, the first and second shafts forming a combined shaft of variable length;

a first section of auger flighting coupled to the first shaft;

a second section of auger flighting coupled to the second shaft, wherein the first and second sections of auger flighting are operable to distribute a slurry material in a spreader box when the first shaft and second shaft are rotated; and a guide pin coupled to an interior surface of the second shaft and engaging the groove, the guide pin causing the second shaft to rotate with respect to the first shaft when the second shaft is extended with respect to the first shaft.

11. The apparatus of claim 10, wherein the second section of auger flighting is fixedly coupled to the second shaft along an inside edge of the second section of auger flighting.

12. The apparatus of claim 11, wherein the first section of auger flighting is coupled to an end of the first shaft distal from the second shaft.

13. The apparatus of claim 12, wherein the first section of auger flighting is in contact with the portion of the second shaft that is coextensive with the first shaft.

14. The apparatus of claim 10, wherein the first shaft is coupled to a first side of the spreader box at an end distal from the second shaft, and the second shaft is coupled to a second side of the spreader box at an end distal from the first shaft.

15. The apparatus of claim 10, wherein the first and second sections of auger flighting have a predetermined pitch and spiral direction.

16. A spreader box of variable width using a telescoping auger shaft, the spreader box comprising:

an expandable box operable to receive slurry material and distribute the slurry material onto a surface; and a first telescoping auger shaft coupled to an interior portion of the expandable box for distributing the slurry material, the telescoping auger shaft comprising:

a first shaft having a guide portion;

a second shaft positioned coaxially with and engaging the first shaft such that the second shaft is operable to extend with respect to the first shaft while remaining engaged with the first shaft, the first and second shafts forming a combined shaft of variable length;

a first section of auger flighting coupled to the first shaft;

a second section of auger flighting coupled to the second shaft, wherein the first and second sections of auger flighting are operable to distribute a slurry material in the spreader box when the first shaft and second shaft are rotated; and a guide element coupled to the second shaft and engaging the guide portion of the first shaft, the guide element causing the second shaft to rotate with respect to the first shaft when the second shaft is extended with respect to the first shaft.

17. The spreader box of claim 16 further comprising a second telescoping auger shaft coupled to the interior portion of the expandable spreader box and comprising the same elements as the first telescoping auger shaft.

18. The spreader box of claim 16 further comprising:

a second expandable spreader box coupled to the first expandable spreader box; and a third telescoping auger shaft coupled to an interior portion of the second expandable spreader box and comprising the same elements as the first telescoping auger shaft.

19. The spreader box of claim 18 further comprising:

a second telescoping auger shaft coupled to the interior portion of the expandable spreader box and comprising the same elements as the first telescoping auger shaft; and a fourth telescoping auger shaft coupled to the interior portion of the second expandable spreader box and comprising the same elements as the first telescoping auger shaft.

20. A method of manufacturing a telescoping auger shaft for distributing slurry material throughout a spreader box of variable width used in a paving system, the method comprising:

providing a first shaft;

providing a second shaft, the second shaft operable to position coaxially and engage the first shaft such that the second shaft is operable to extend with respect to the first shaft while remaining engaged with the first shaft, the first and second shafts forming a combined shaft of variable length;

coupling a first section of auger flighting to the first shaft and coupling a second section of auger flighting to the second shaft, the two sections of auger flighting operable to distribute a slurry material in a spreader box when the first shaft and second shaft are rotated;

coupling a guide portion to the first shaft; and coupling a guide element to the second shaft, the guide element operable to engage with the guide portion such that the guide element causes the second shaft to rotate with respect to the first shaft when the second shaft is extended with respect to the first shaft.

21. The method of claim 20, further comprising the step of forming an interior portion of the second shaft to receive the first shaft.

22. The method of claim 20, further comprising the step of fixedly coupling the second section of auger flighting to the second shaft along an inside edge of the second section of auger flighting.

23. The method of claim 22, further comprising the step of coupling the first section of auger flighting to an end of the first shaft distal from the second shaft.

24. The method claim 23, further comprising the step of coupling the first section of auger flighting such that the first section of auger flighting is operable to contact a portion of the second shaft that is coextensive with the first shaft when the second shaft is coupled to the first shaft.

25. The method of claim 20, wherein the step of coupling the guide portion to the first shaft comprises the step of forming a groove into an exterior surface of the first shaft.

26. The method of claim 25, wherein the step of coupling the guide element to the second shaft comprises the step of forming the guide pin as a member coupled to an interior surface of second shaft.

27. The method claim 20, further comprising the steps of:

coupling the first shaft to a first side of a spreader box at an end distal from the second shaft; and coupling the second shaft to a second side of a spreader box at an end distal from the first shaft.

* * * * *